United States Patent [19]

Bryan et al.

[11] Patent Number: 4,679,037

[45] Date of Patent: Jul. 7, 1987

[54] ATTACHMENT FOR SMOKE ALARMS

[76] Inventors: Horace Bryan, 12 Brighton La. 10, Brooklyn, N.Y. 11235; Nicholas Giardina, 50-11 Poyer St., Elmhurst, N.Y. 11373

[21] Appl. No.: 809,320

[22] Filed: Dec. 16, 1985

[51] Int. Cl.[4] ..... G08B 17/10; G08B 21/00

[52] U.S. Cl. ..... 340/693; 340/628

[58] Field of Search ..... 340/693, 628, 629, 630

[56] References Cited

U.S. PATENT DOCUMENTS 4,228,428 10/1980 Niedermeyer ..... 340/693
4,313,110 1/1982 Subulak et al. ..... 340/628
4,383,251 5/1983 Perelli et al. ..... 340/628
4,567,477 1/1986 Cormier ..... 340/628
4,600,314 7/1986 Theriault ..... 340/628

*Primary Examiner*—Glen R. Swann, II
*Attorney, Agent, or Firm*—Erwin S. Teltscher

[57] ABSTRACT

An attachment is provided which can be retrofitted to conventional smoke alarms to make it possible to deactivate the smoke alarm in order to avoid operation of the alarm as a result of intentionally produced smoke which does not represent the threat of fire. The attachment provides a signal that the smoke alarm has been deactivated, the signal serving to remind occupants that the alarm is deactivated. Particularly advantageous embodiments make it simple and easy to replace the battery of the smoke alarm.

11 Claims, 12 Drawing Figures

ATTACHMENT FOR SMOKE ALARMS

BACKGROUND OF THE INVENTION

This invention relates to smoke alarms and particularly to attachments for rendering conventional battery operated smoke alarms more useful.

It has long been recognized that detection of smoke in dwellings, stores, restaurants and other buildings defining spaces to be occupied is a major way in which loss of life by fire can be reduced, and use of the so-called single station smoke alarm has become a standard practice. While the many types of such alarms now available differ widely as to detail, they ordinarily comprise a housing which carries an electrically operated signal device, usually a sounder, a smoke responsive device operative to provide a control signal to the signal device when subjected to smoke, a battery for operating the signal device, and circuit means interconnecting the signal device, smoke responsive device and battery. Such alarms are usually mounted on a ceiling or in an elevated location on a wall and ordinarily can be reached, as for replacing the battery, only by climbing a short ladder or the like.

While such smoke alarms have received wide acceptance, their installation now being required by law in many areas, they present two problems. First, in order to be adequately sensitive to provide early detection of smoke in the event of a threatening fire, the alarms respond to smoke produced intentionally and not representing the threat of fire. For example, when such an alarm is installed on the ceiling of a hallway adjacent a kitchen, the alarm frequently responds to smoke resulting from broiling food in the kitchen. Similarly, installed on the ceiling of an eating space in a restaurant, when the eating space is near the doorway to the restaurant kitchen, such an alarm responds to smoke from the kitchen, admitted to the eating space each time the door is opened when carrying food to the eating space. So as to be readily noticed, the audible sound of the alarm is persistent and irritating and, when the purposely produced smoke condition is such as to continue for a period of time, the only relief is to climb up and deactivate the smoke alarm, usually by disconnecting the battery. The second problem stems from the fact that, with time, the battery or batteries become discharged so that the smoke alarm becomes inoperative. While the battery or batteries can be replaced readily, this requires climbing to within reach of the smoke alarm and there is a strong human tendency to delay replacing the battery. Many such alarms are designed to alert the user of impending battery failure by emitting periodic short sounds, but although such warnings occur over a relatively long period of time they are frequently ignored. In some cases, the two problems aid each other, since the user who has recently been irritated by having to deactivate the alarm because it responded to purposely produced smoke is more likely to delay replacing the battery when it has become discharged, and the user who has to deactivate the alarm because it is responding to purposely produced smoke is likely to leave the battery disconnected for awhile.

Though the tendency for such smoke alarms to respond to purposely produced smoke, and thus be irritating, clearly works against the purpose of the alarm, proposals for providing easy ways to temporarily deactivate the alarm have apparently had little acceptance. Though the design of the alarm can be changed to provide a deactivating switch, as disclosed in U.S. Pat. No. 4,313,110 to Subulak et al, that could best be done by the manufacturer of the smoke alarm, and the alarm manufacturers appear not to have accepted the need for change. There has accordingly been a continuing need for improvement.

SUMMARY OF THE INVENTION

The invention provides a retrofit attachment for conventional battery operated smoke alarms which not only makes it possible to easily deactivate a smoke alarm which is responding to purposely produced smoke but also minimizes the possibility that, once deactivated, the alarm will be left in its deactivated condition. In particularly advantageous embodiments, the invention eliminates the necessity of climbing up to, e.g., a ceiling-mounted smoke alarm in order to replace the battery or batteries.

Considered broadly, attachments according to the invention comprise a plurality of elongated flexible conductors combined to form a flexible pendant of substantial length, the conductors at one end of the pendant being provided with means for connectng the conductors electrically to the circuit means of the smoke alarm, and at least a switch carried by a portion of the pendant at the other end thereof, the switch and conductors beng so connected electrically that when the switch is in one condition, the smoke alarm cannot receive power from the battery. Once installed, the pendant is supported by its connection to the smoke alarm and depends therefrom, the arrangement being such that a lower end portion of the pendant, including the switch, can be bent upwardly and secured to an intermediate portion of the pendant releasably, when the switch has not been conditioned to deactivate the alarm, in which case the observable length of the pendant has been reduced to an extent such that the pendant is not in the way, but the length of the pendant thus reduced is still such that one standing on the floor beneath the alarm can easily reach and detach the lower end portion of the pendant, whereupon the pendant can stretch to its full length so that the lower end thereof will be not only readily observable but also in the way of foot traffic so as to act as a reminder that the alarm has been deactivated. Observability of the lower end of the pendant can be increased by adding a visible indicator, which may be a signal light energized from the smoke alarm battery when the switch has been conditioned to deactivate the alarm, or a visible flag or a light reflective device displayed for view when the pendant has been extended to its full length. In particularly advantageous embodiments, the pendant also carries a battery holder which supports the battery or batteries of the smoke alarm, and the location of the battery holder on the pendant is such that the battery or batteries can be reached for replacement by one standing on the floor beneath the smoke alarm.

IDENTIFICATION OF THE DRAWINGS

DETAILED DESCRIPTION OF THE INVENTION

The Embodiment of FIGS. 1-5

Figure 1:
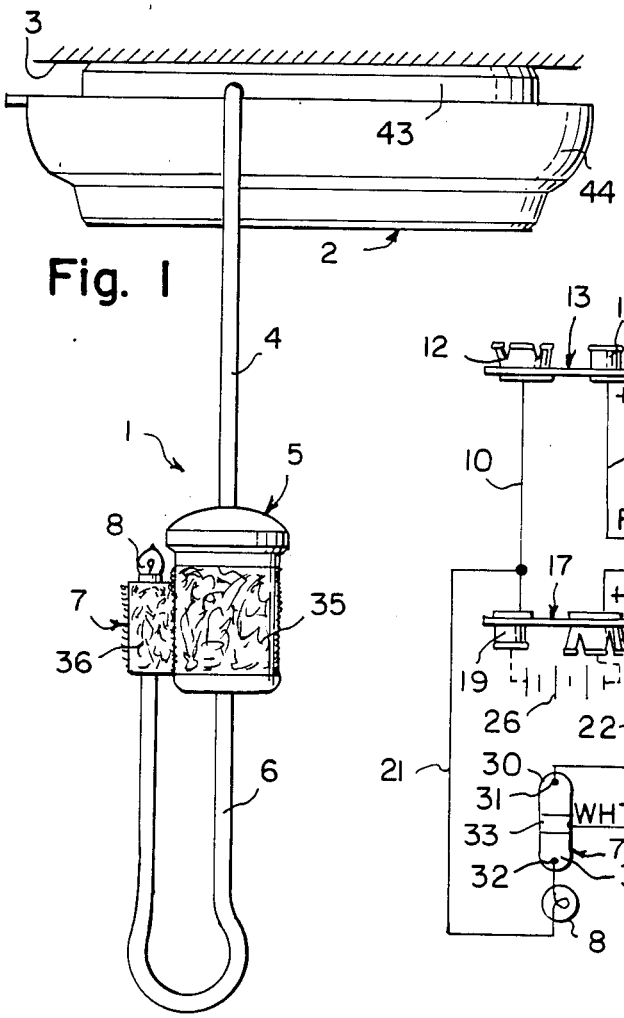
FIG. 1 is a side elevational view of a smoke alarm retrofitted with an attachment according to one embodiment of the invention and showing the pendant in its stowed position.

FIGS. 1-5 illustrate an attachment according to one embodiment of the invention and indicated generally at 1 applied to a conventional battery operated smoke alarm 2 mounted on a room ceiling 3. The attachment comprises a length of flexible, insulated two-conductor electrical lead 4, a battery holder 5, a length of three-conductor flexible insulated electrical lead 6, a position sensitive switch 7 and a signal lamp 8. Conductors 9 and 10, FIG. 3, of lead 4 are connected at one end to male connector 11 and female connector 12 of a conventional connector 13 of the type used in smoke alarms to connect the circuit means of the alarm to the battery.

Figure 5:
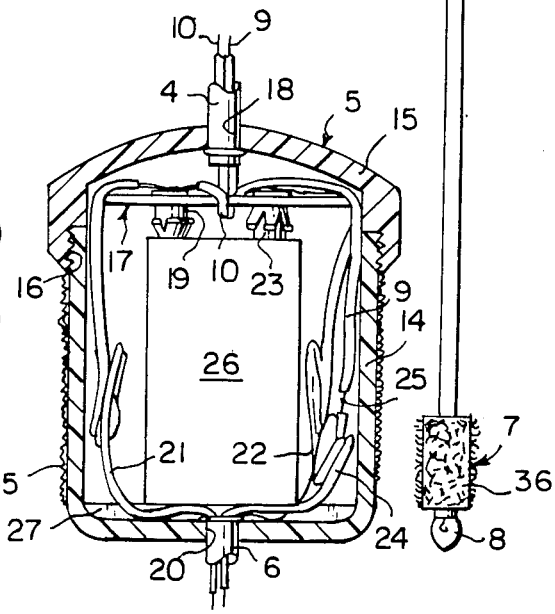
FIG. 5 is a longitudinal sectional view of a battery holder forming part of the pendant.

Battery holder 5 comprises a cup-shaped main body 14, FIG. 5, and a cover 15, the cover being releasably secured, as by threads at 16, to close the main body. A connector 17 identical to connector 13 is fitted to the inner side of cover 15. The cover has a central aperture 18 through which lead 4 extends. Conductor 10 of lead 4 is conencted to male connector member 19 of connector 17. The upper end portion of lead 6 extends through an aperture 20 in the bottom of body 14. One conductor 21 of lead 6 extends upwardly within the battery holder and is connected to male element 19 of connector 17. A second conductor 22 of lead 6 is similarly connected to the female element 23 of connector 17. The third conductor 24 is lead 6 is connected at 25 to conductor 9 of lead 4. Battery 26, usually a 9 V. primary battery, rests on ledge 27 at the bottom of body 14 and has its terminals engaged with terminals 19 and 23, respectively, of connector 17.

Figure 3:
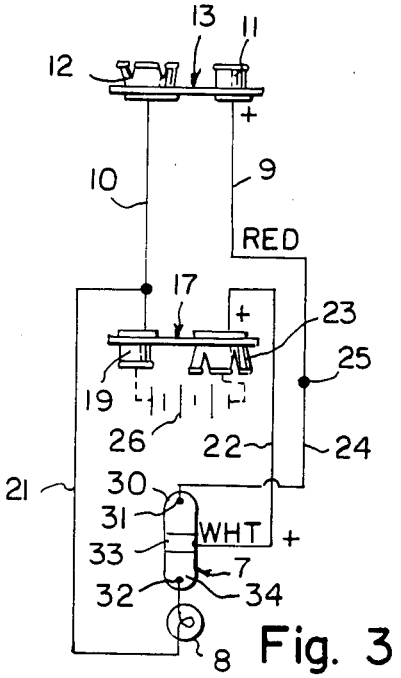
FIG. 3 is a schematic electrical diagram of the attachment illustrated in FIGS. 1 and 2.

In this embodiment, switch 7 is position responsive, and can be a conventional mercury switch of the general type illustrated schematically in FIG. 3. Thus, the switch comprises a sealed elongated insulating chamber 30, a first contact 31 fixed within one end of the chamber and connected electrically to conductor 24, a second contact 32 fixed within the opposite end of the chamber and connected electrically to one terminal of lamp 8, a ring-shaped third contact 33 fixed within the chamber in a location midway between and spaced from contacts 31 and 32, contact 33 being connected electrically to conductor 22, and a body of liquid mercury 34 of a volume adequate to half fill chamber 30 when the chamber is disposed with its long axis upright. The remaining terminal of lamp 8 is connected electrically to conductor 21.

Figure 2:
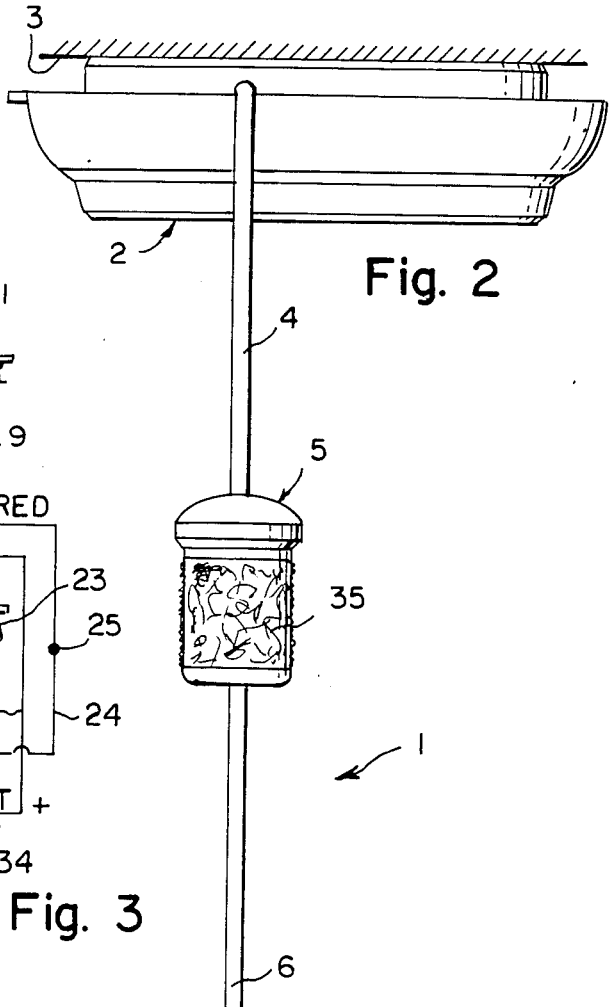
FIG. 2 is a view similar to FIG. 1 but showing the pendant extended to its full length.

The outer surface of main body 14 of the battery holder is wrapped with a piece of fabric 35. Switch 7 is wrapped with fabric 36. The two pieces of fabric are respectively of the hook type and loop type so as to cooperate in releasable connector fashion as a hook-and-loop fastener in the manner taught, e.g., in U.S. Pat. No. 3,009,235 to de Mestral, such fastener materials being conventional and marketed under the trademark VELCRO® by Velcro USA Inc., Manchester, N.H. USA. Accordingly, switch 7 can be secured firmly but releasably to body 14 of battery carrier 5 simply by inverting the switch (so contact 32 is uppermost) and pressing the switch against body 14 of the battery holder so that the switch is in a stowed position, lead 6 depends only a relatively short distance below the battery holder, and a circuit comprising conductors 9 and 24, contact 31, mercury 34, contact 33, conductor 22, battery 26 and conductor 10 is completed. The length of lead 4 is such that, with that lead connected to alarm 2 as later described, battery holder 5 is suspended from the ceiling-mounted alarm by a distance bringing the battery holder within reach of a person standing on the floor below the smoke alarm. The length of lead 6 is such that, with switch 7 in the stowed position seen in FIG. 1, and with lead 6 then depending as a loop, the loop is just above the average height of persons traversing the space below the smoke alarm and attachment 1 is therefore not an obstacle. When the switch is detached from the battery holder, lead 6 then becomes fully extended, as seen in FIG. 2, and the position of the switch is reversed from that which exists in the stowed position. Accordingly, with the attachment fully extended as in FIG. 2, mercury 34 bridges only the space between contacts 32 and 33, making it impossible for current to flow from the battery via conductor 9 but completing a circuit via conductor 21, lamp 8, contact 32, mercury 34, contact 33 and conductor 22. Thus, when the attachment is in the position shown in FIG. 2, lamp 8 is energized from battery 26 but the smoke alarm is deactivated.

Figure 4:
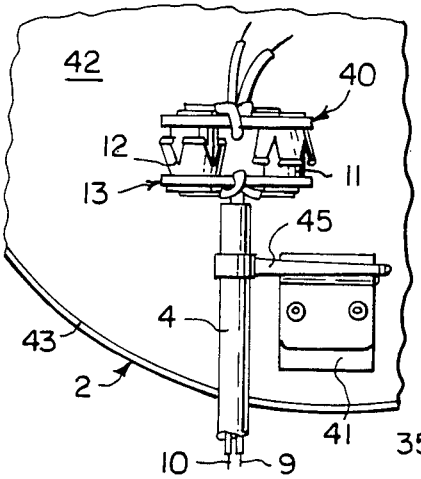
FIG. 4 is a fragmentary bottom plan elevational view of the smoke alarm of FIG. 1 with the lower housing portion removed, showing the manner in which the pendant is connected to the smoke alarm.

The attachment can be applied as a retrofit to any conventional smoke alarm having a housing which allows connector 13 and an end portion of lead 4 to be inserted so that, as seen in FIG. 4, connector 13 can be operatively engaged with the mating standard connector 40 of the smoke alarm. Connector 40 in standard use serves to connect the electrical circuit of the smoke alarm to a battery (not shown) releasably held by a conventional battery clip 41 but, since with use of attachment 1 the battery is in holder 5, clip 41 is empty and available for use as a tie point for the attachment. In the case illustrated, clip 41 is secured by rivets to top wall 42 of upper housing portion 43 of the smoke alarm and the space adjacent the clip is readily accessible simply by swinging down the hinged lower portion 44 of the housing, so that connector 13 can be snapped into engagement with connector 40 and the end portion of lead 4 secured to one portion of clip 41, as by a conventional alligator clip 45. When lower portion 44 is then swung back to its closed position, seen in FIGS. 1 and 2, lead 4 crosses over the upper edge of portion 44 and the attachment is suspended as shown.

While in conventional smoke alarms the battery is mounted within the housing of the smoke alarm, and therefore can frequently be reached only by climbing up on a stool or ladder, use of attachments according to this embodiment of the invention present the battery, in holder 5, in a position which can be reached by a person standing beneath the smoke alarm. Thus, when the battery must be replaced, it is only necessary to reach up, unscrew body 14 from cover 15, remove the old battery and insert a new one, enough excess length of conductors 21, 22 and 24 being provided to allow body 14 to be pulled down somewhat from the cover.

The Embodiment of FIGS. 6–10

Figure 8:
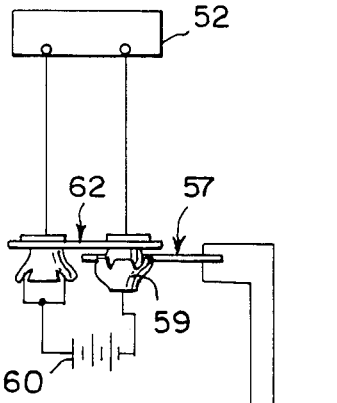
FIG. 8 is a schematic electrical diagram of the attachment illustrated in FIGS. 6 and 7.

Though it is most advantageous to have the battery for powering the smoke alarm constitute part of the pendant of the attachment, and thus be within reach of the floor for easy replacement, attachments according to the invention can be used with the battery remaining in its mount within the smoke alarm housing, as in the embodiment shown in FIGS. 6–10. Here, the attachment is indicated generally at 51, the smoke alarm at 52 and the surface on which the alarm is mounted, such as a room ceiling, at 53. Attachment 51 is again in the form of a pendant and comprises, as seen in FIG. 8, an elongated flexible insulated two-conductor lead 54, conductors 55 and 56 of the lead being connected at one end of the lead electrically and mechanically to a connector indicated generally at 57 and at the other end to the fixed and movable contacts, respectively, of a conventional manually operated switch 58.

In this embodiment, connector 57 is adapted to be interposed between the female negative terminal 59 of the battery 60 of the smoke alarm and the cooperating male terminal 61 of the connector 62 which is a standard part of the smoke alarm 52, the arrangement beng such that connector 57 insulates terminals 59 and 61 from direct electrical contact but connects terminal 59 to conductor 55 and terminal 61 to conductor 56, so that the battery is connected electrically to the smoke alarm only via switch 58. Connector 57 also cooperates with the battery and connector 62 to secure the corresponding end of lead 54 to the smoke alarm housing, via the usual battery clip, so that the attachment is supported as a pendant from the smoke alarm.

In this embodiment, connector 57 is a highly flexible laminated structure (FIG. 9) comprising an intermediate lamina 65 of flexible insulating material, typically a polytetrafluoroethylene foil of 0.005–0.015 in. thickness, and two thin metal laminae 66 and 67 each adhered to a different one of the major faces of lamina 65. Viewed in plan, the connector is in the form of an elongated rectangle with laminae 66 and 67 being smaller than lamina 65 so that the respective edges of the metal laminae are spaced significantly inwardly from the corresponding edges of the intermediate insulating lamina and with the overall width of the laminate being approximately equal to or slightly greater than the diameter of the mouth of female terminal 59. The end portions of conductors 55 and 56 are connected, both electrically and mechanically, respectively to metal laminae 66 and 67, and the end portion of connector 57 to which conductors 55,56 are joined and the adjacent end portion of lead 54 are then covered by shrink-on polymeric insulating sleeve 68.

Figure 9:
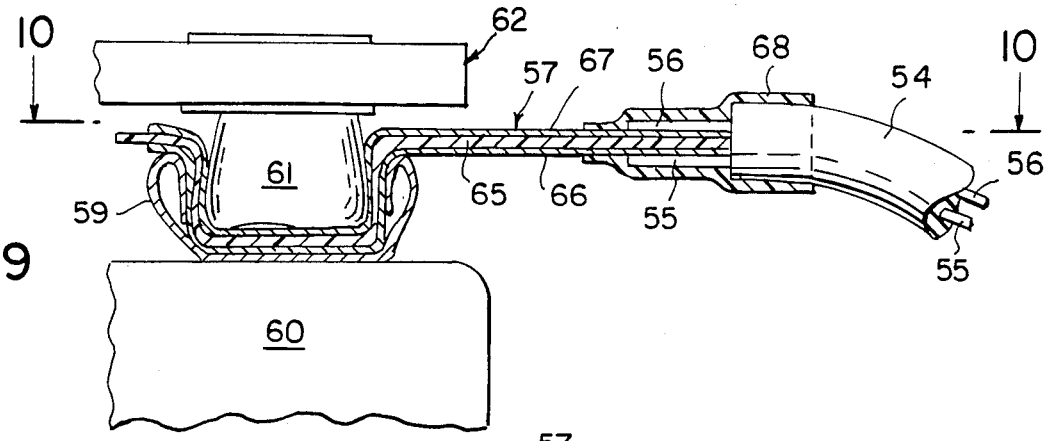
FIG. 9 is a fragmentary view, partly in side elevation and partly in cross section, of a connector forming part of the attachment shown in FIGS. 6 and 7.
Figure 10:
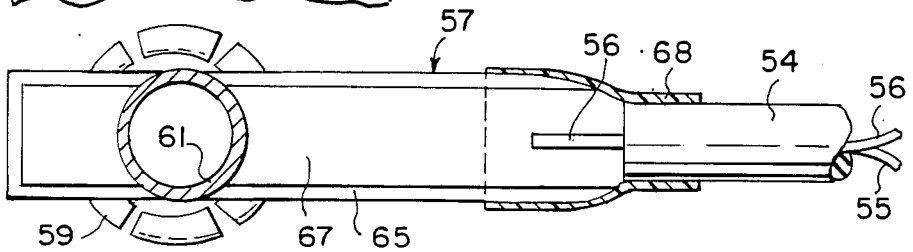
FIG. 10 is a view taken generally on line 10—10, FIG. 9.
Figure 6:
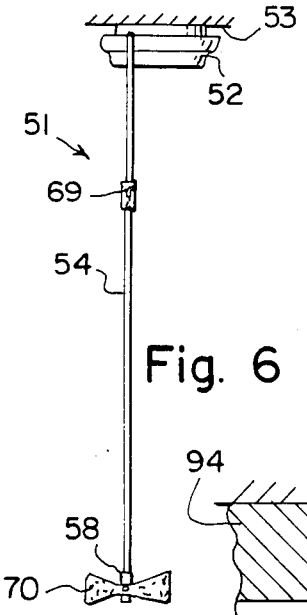
FIG. 6 is a side elevational view of a smoke alarm retrofitted with an attachment according to another embodiment of the invention and showing the pendant extended to its full length.
Figure 7:
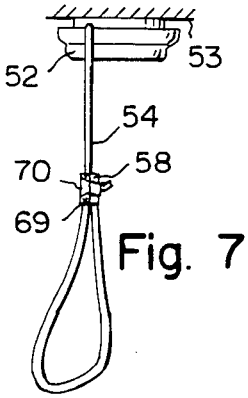
FIG. 7 is a view similar to FIG. 6 but showing the pendant in its stowed position.

Lead 54 is of such length that, when connector 57 is clamped between terminals 59 and 61, as shown in FIG. 9, and lead 54 is run out of the housing of the smoke alarm and extended to its full length, as seen in FIG. 6, the free end of the lead, with switch 58 connected thereto, will be suspended at, e.g., eye level. At a point below but near smoke alarm 52, lead 54 is wrapped with a piece of fabric 69. A second piece of fabric 70, shaped to appear as a signal flag when freely extended, is secured at its midpoint to switch 58. The two fabric pieces are such as to coact in releasable hook-and-loop fastener fashion, as according to the aforementioned de Mestral patent. Accordingly, when switch 58 is closed, so that battery 60 can supply current to the smoke alarm via conductors 55 and 56, the switch can be held against wound fabric 69 and fabric 70 then folded about fabric 69 to secure the switch releasably to fabric 69 and therefore to lead 54, the portion of lead 54 between fabric 69 and switch 58 then being suspended as a loop, as seen in FIG. 7, which is above head height and therefore not an obstruction to foot traffic. When the smoke alarm has been activated by purposely produced smoke, one can reach up, detach fabric 70 from fabric 69, actuate switch 58 to its open position so as to deactivate the smoke alarm, and leave lead 54 fully extended, as in FIG. 6, with fabric 70 freely extended to serve as a signal indicating that the smoke alarm is deactivated.

Figure 11:
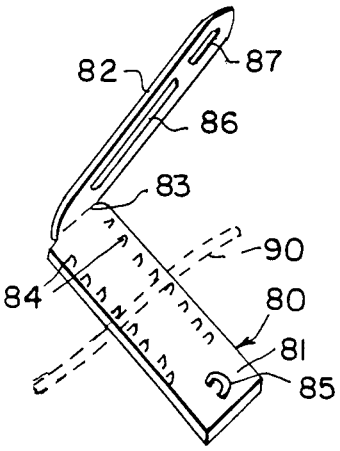
FIG. 11 is a perspective view of a clamp which can be secured on the uppermost electrical lead of the pendant as an alternative stress relief device.
Figure 12:
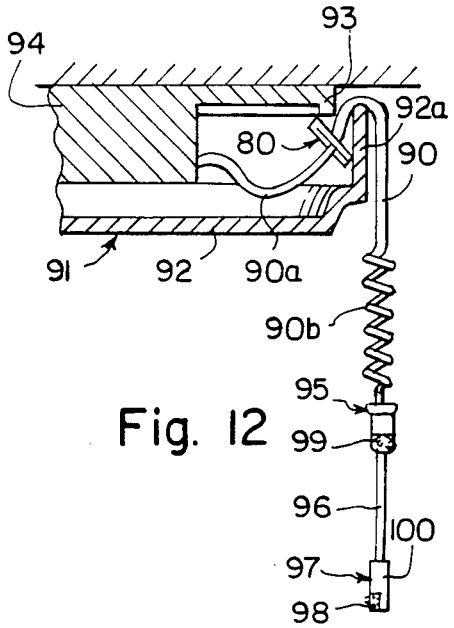
FIG. 12 is a semidiagrammatic view illustrating the manner in which the clamp of FIG. 11 is used and also showing a modification of the pendant.

As an alternative to the strain relief feature shown in FIG. 4, a conventional clamp 80, FIG. 11, can be secured on the upper end portion of the pendant in a position such that, when the pendant has been attached to the smoke alarm, the clamp will be inside of the smoke alarm housing and will coact with, e.g., the side wall of the housing as a stop to accept downward strains applied to the pendant. Clamp 80 can be in the form of an integral piece of polymeric material, typically polypropylene, defining a base 81 and a clmping arm 82 hinged to base 81 by an integral hinge 83, the base having teeth 84 and a locking lug 85, the clamping arm having a longitudinal ridge 86, to cooperate with the teeth when the clamp is closed, and an opening 87 to accept lug 85. Using this alternative, as seen in FIG. 12, the connector (not shown) at the end of lead 90 at the upper end of the pendant is mated with the connector of smoke alarm 91 as hereinbefore described, while cover 92 of the smoke alarm is open, clamp 80 is clamped onto lead 90, and cover 92 is closed with clamp 80 now inside the cover and with lead 90 extending over the upper edge of side wall 92*a* of the cover. The position of clamp 80 on lead 90 is such that a downward strain on the pendant causes clamp 80 to engage the inner face of side wall 92*a* as well as the outer edge portion 93 of the upper housing portion 94 of the smoke alarm. With the position of clamp 80 being so chosen that portion 90*a* of the lead is slack, all strains applied downwardly to the pendant are accepted by the clamp and portions 92*a* and 93 of the housing.

In all embodiments, pulling the pendant downwardly, as to gain access to battery holder 95 when one is used, can be made easier by making at least a portion of lead 90, FIG. 12, in the form of a helical spring 90*b*. Use of this feature allows the normal position of the battery holder to be nearer the ceiling, When the helical spring is relaxed, yet allows the battery holder to be pulled within easy reach. In the embodiment shown in FIG. 12, lead 96 of the pendant is connected as hereinbefore described and extends between the lower end of the battery holder and switch means 97, the switch means including a mercury switch as described with reference to FIG. 3 but no signal light being included. A piece of fabric 98, constituting one element of a hook-and-loop type separable fastener, is wrapped around and secured to the switch means but covers only a portion of the outer surface thereof. A piece of fabric 99 constituting the other portion of the separable fastener is wrapped around and secured to the casing of battery holder 95 so that the switch means can be detachably secured to the battery holder, as hereinbefore described, with the switch then being in condition to allow the smoke alarm to operate. The remaining portion 100 of the outer surface of switch means 97 is made highly refractive, fluorescent or irridescent so as to constitute a visible signal when the switch means is in the position shown in FIG. 12 and the switch is therefore in condition to deactivate the smoke alarm.

It will be apparent that various changes and modifications can be made without departing from the scope of the invention as defined in the appended claims. Thus, for example, instead of releasably securing the switch means to a battery holder or to an intermediate portion of the pendant other than a battery holder to place the switch in that condition in which the smoke alarm is operative, the switch means can be releasably secured to the smoke alarm housing itself.

What is claimed is:

1. In an attachment for use with smoke alarms of the type to be mounted in an elevated position in a space to be monitored for occurrence of smoke and which comprise a housing carrying an electrically operated signal device, a smoke responsive device, and circuit means connected to the signal device and the smoke responsive device and including a connector for connection to a battery, the combination of an elongated flexible electrical lead;

switch means supported by the lead;

connector means at an end of the lead spaced a substantial distance from the switch means and operative for connecting a battery to the circuit means of the smoke alarm only when the connector means is connected to the connector of the circuit means of the smoke alarm and the switch means is in a predetermined first condition, the switch means being operative to have a second condition disabling the smoke alarm;

the combination of the electrical lead, switch means and connector means constituting a flexible pendant which can depend from the smoke alarm with the switch means in a first position substantialy below the smoke alarm when the connector means is connected to the connector of the circuit means of the smoke alarm; and releasable means for releasably securing the switch means in a second position substantially above said first position, the switch means being in said first condition when occupying said second position, the switch means being in a second condition, in which the smoke alarm is disabled, when the switch means occupies said first position.

2. The combination defined by claim 1, wherein the releasable means is constructed and arranged to releasably secure the switch means to an intermediate portion of the pendant.

3. The combination defined by claim 1, wherein the switch means comprises a position responsive switch.

4. The combination defined by claim 1, wherein the switch means comprises a manually operated switch.

5. The combination defined by claim 1 and further comprising signal means carried by the pendant and observable as an indication that the smoke alarm has been disabled when the switch means occupies said first position.

6. The combination defined by claim 5, wherein the signal means comprises an electrically operated light source;

the combination further comprising conductor means constituting part of the pendant and connecting the light source to a battery only when the switch means is in said first position.

7. The combination defined by claim 5, wherein the signal means is carried by the switch means.

8. The combination defined by claim 5, wherein the releasable means for securing the switch means in said second position comprises first means secured to the battery holder, and second means secured to the switch means and constructed and arranged to cooperate with said first means for releasably securing the switch means to the battery holder.

9. The combination defined by claim 8, wherein said first and second means of the releasable means are fabric pieces constituting a hook-and-loop fastener.

10. The combination defined by claim 1 and further comprising a battery holder adapted to releasably support a battery for powering the smoke alarm, the battery holder being carried by the pendant and so located thereon that, when the pendant is suspended from the smoke alarm, the battery holder can be reached from the floor of the space to be monitored for occurrence of smoke.

11. The combination defined by claim 1, wherein the connector means comprises a flexible laminate including an intermediate lamina of flexible electrical insulating material having two major faces, a first flexible conductive lamina secured to one major face of the intermediate lamina, and a second flexible conductive lamina secured to the other major face of the lamina, each of two conductors of the flexible electrical lead being connected to a different one of the first and second conductive laminae and to a different terminal of the switch means whereby, when the laminate is interposed between mated male and female connectors of a battery and the smoke alarm connector, current can be supplied by the battery to the smoke alarm only via the switch means.

* * * * *